US006227079B1

(12) United States Patent
Liu

(10) Patent No.: US 6,227,079 B1
(45) Date of Patent: May 8, 2001

(54) SELF ADJUSTING TOOL

(76) Inventor: Kuo Chen Liu, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/488,052

(22) Filed: Jan. 20, 2000

(51) Int. Cl.[7] ..... B25B 13/12
(52) U.S. Cl. ..... 81/126; 81/127; 81/146; 81/90.1
(58) Field of Search ..... 81/126, 127, 146, 81/90.1

(56) References Cited

U.S. PATENT DOCUMENTS 4,995,297 * 2/1991 Richards .
5,231,904 * 8/1993 Masbaum .
5,568,752 * 10/1996 Alford .
5,682,802 * 11/1997 Mazzone .

* cited by examiner

*Primary Examiner*—Timothy V. Eley
*Assistant Examiner*—Willie Berry, Jr.

(57) ABSTRACT

A tool includes a head having a fixed jaw, a movable jaw slidably engaged in the head and movable toward and away from the fixed jaw for clamping the fastener to be driven. A handle has a portion pivotally secured to the head at a pivot shaft and has an actuation portion selectively engaged with the head via gears and a pinion to force the movable jaw toward the fixed jaw and to drive the fastener. A pin is slidably engaged in the handle for limiting a rotational movement between the handle and the head. A spring may bias the movable jaw toward the fixed jaw.

13 Claims, 6 Drawing Sheets

SELF ADJUSTING TOOL

BACKGROUND OF THE INVENTION

1. Field of the Invention

The present invention relates to a tool, and more particularly to a self adjusting tool.

2. Description of the Prior Art

Typical adjusting wrenches comprise a fixed jaw and a movable jaw adjusted relative to the fixed jaw for clamping and for driving fasteners. The movable jaw may not be self adjusted relative to the fixed jaw and should be adjusted by the users.

The present invention has arisen to mitigate and/or obviate the afore-described disadvantages of the conventional tools.

SUMMARY OF THE INVENTION

The primary objective of the present invention is to provide a tool including a self adjusting mechanism for allowing the tool to drive the fasteners without being disengaged from the fasteners.

In accordance with one aspect of the invention, there is provided a tool comprising a head including a first end having a first jaw provided thereon and including a second end, a second jaw slidably engaged in the head and movable toward and away from the first jaw for clamping a fastener to be driven between the first and the second jaws, and a handle including a first portion pivotally secured to the first end of the head at a pivot shaft and including a second portion selectively engaged with the second end of the head to force the second jaw toward the first jaw and to engage with the fastener.

A limiting means is further provided for limiting a rotational movement of the handle relative to the head about the pivot shaft and includes an oblong hole formed in the second portion of the handle, and a pin secured in the second end of the head and slidably received in the oblong hole of the handle to limit the rotational movement of the handle relative to the head.

The head includes a groove formed therein, the second jaw includes a protrusion extended therefrom and slidably engaged in the groove of the head for guiding the second jaw to move toward and away from the first jaw. A spring biasing means is further provided for biasing the second jaw toward the first jaw to lock the fastener between the first and the second jaws. The head includes a cover plate secured thereto for slidably retaining the second jaw in the head.

The second portion of the handle includes an actuator for engaging with the second jaw and for forcing the second jaw toward the first jaw. The second jaw includes a rack provided thereon, the actuator of the handle is engaged with the rack of the second jaw for forcing the second jaw toward the first jaw.

One or more first gears are rotatably secured in the head and engaged with the rack, a second gear is rotatably secured in the head and engaged with the first gears, the actuator of the handle is engaged with the rack of the second jaw with the first and the second gears for forcing the second jaw toward the first jaw. A pinion is received in the handle and selectively engaged with the first and the second gears when the second portion is forced toward the second end of the head. The handle includes a depression formed therein for receiving the first and the second gears and the pinion. A spring biasing device is further provided for biasing the second portion of the handle away from the second end of the head.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
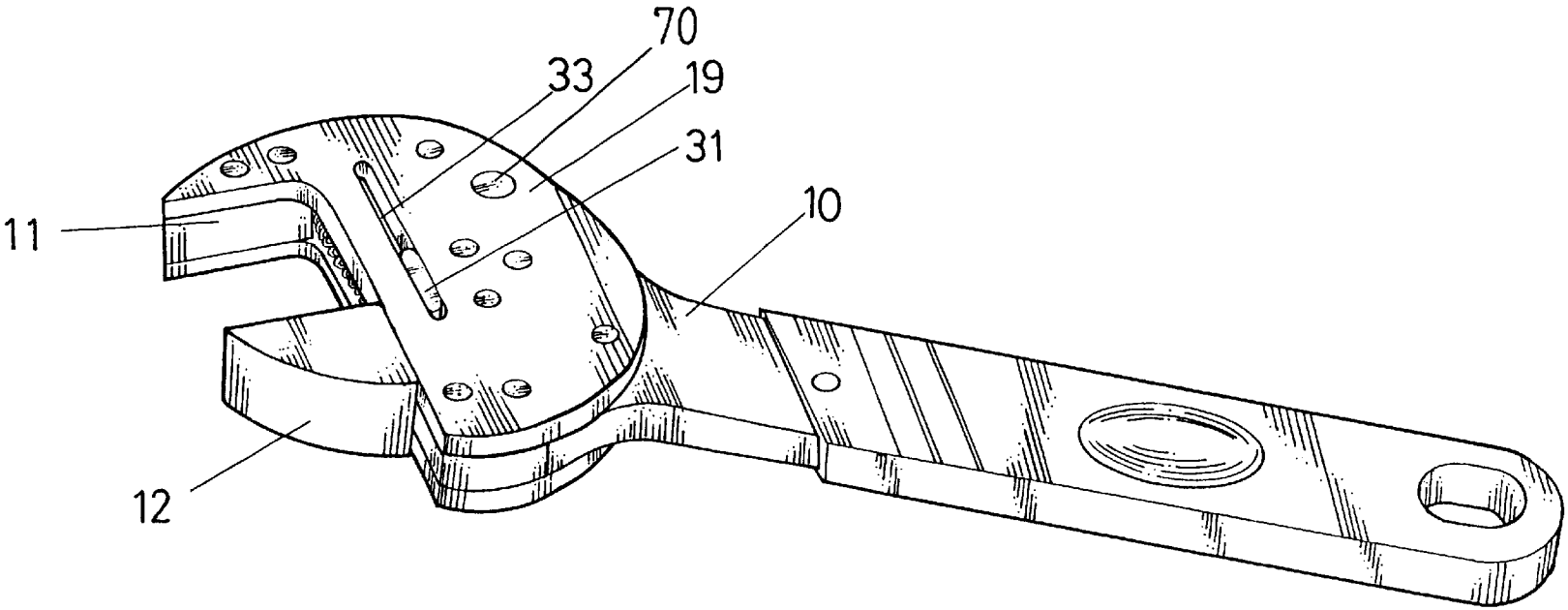
FIG. 1 is a perspective view of a tool in accordance with the present invention.
Figure 2:
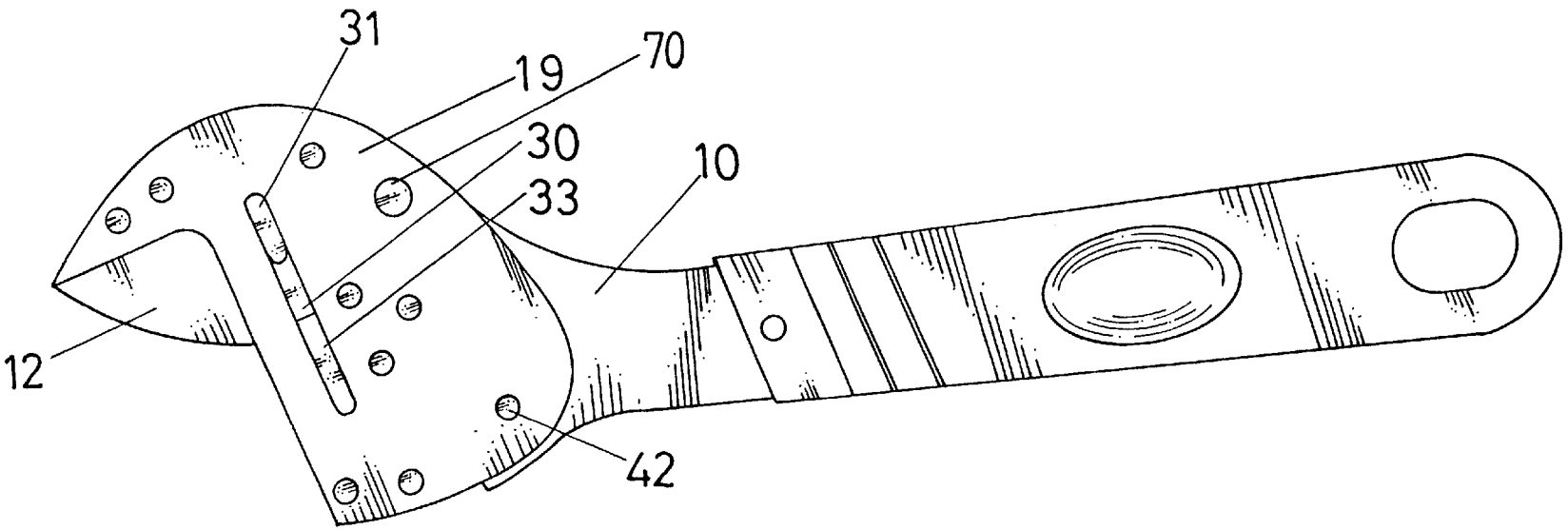
FIG. 2 is a top plane view of the tool.
Figure 3:
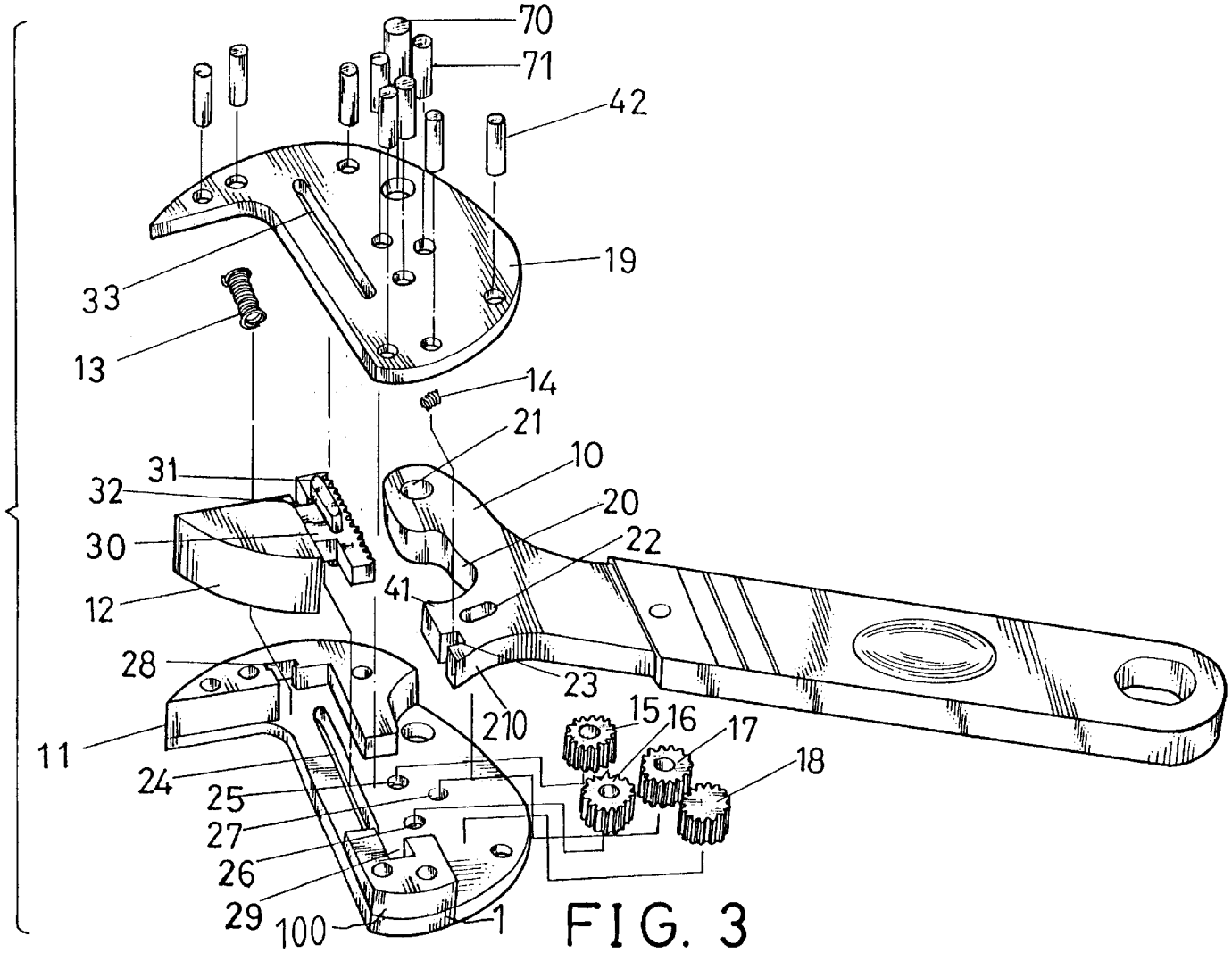
FIG. 3 is an exploded view of the tool.
Figure 4:
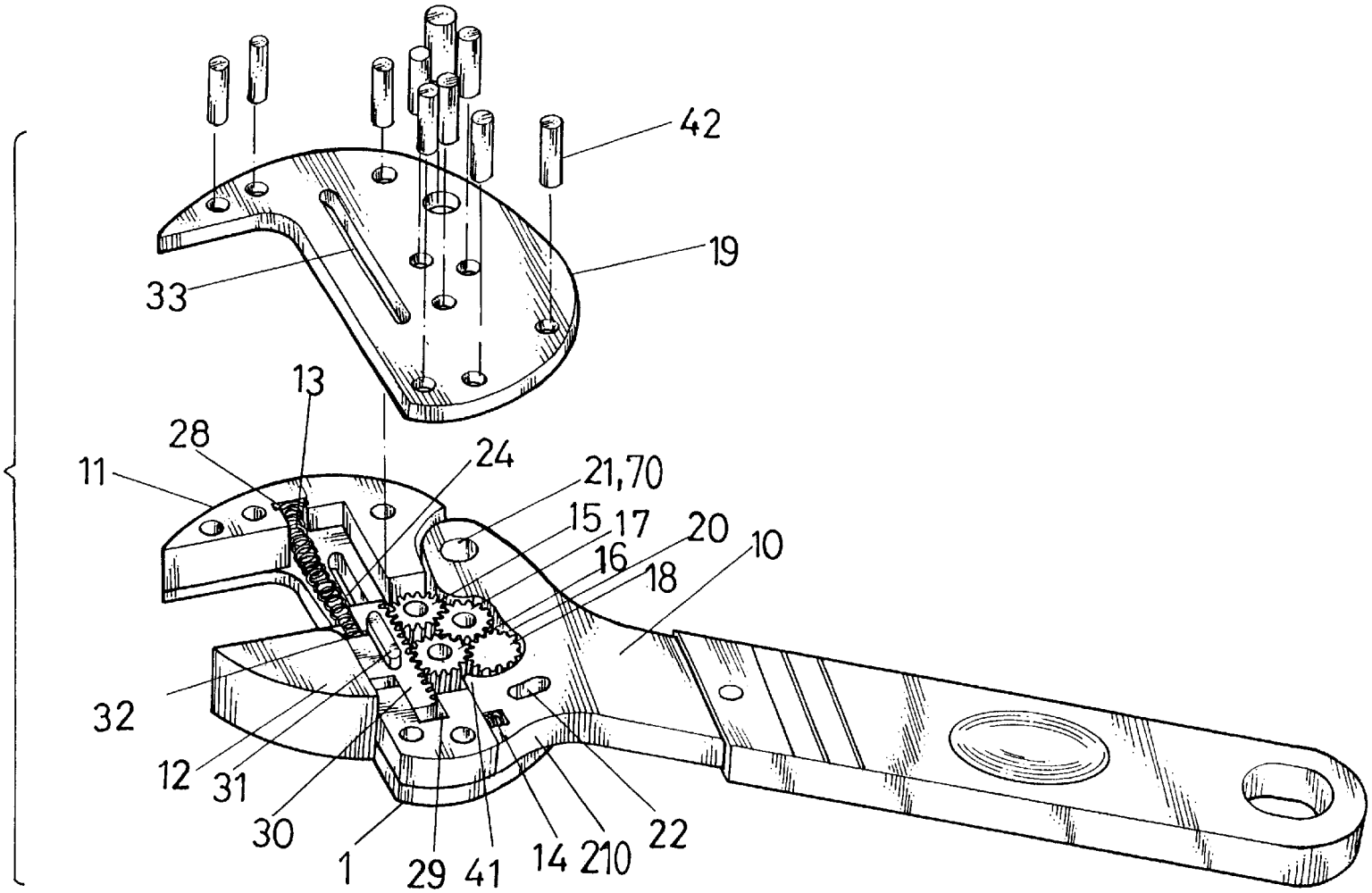
FIG. 4 is a partial exploded view of the tool.

Referring to the drawings, and initially to FIGS. 1–5, a tool in accordance with the present invention comprises a head 1 including a fixed jaw 11 formed and provided on one end thereof and including a channel 29 formed in the other end thereof and preferably formed in a block 100 of the head 1 and including a groove 24 formed therein and formed between the ends of the head 1 and communicating with the channel 29 of the head 1. A handle 10 includes one end having a depression 20 formed therein and having an actuator 41 extended inward of the depression 20 of the handle 10 and having a first side 21 pivotally secured to the one end of the head 1 at a pivot shaft 70 and having a recess 23 formed in the second side thereof for receiving a spring 14. The handle 10 is rotatable relative to the head 1 about the pivot shaft 70 such that the second side of the handle 10 is movable toward and away from the block 100 of the head 1. The second side 210 of the handle 10 includes an oblong hole 22 formed therein for relatively and slidably receiving a pin 42. The pin 42 is secured to the head 1 and relatively and slidably received in the oblong hole 22 of the handle 10 and movable between the ends of the oblong hole 22 for limiting the rotational movement of the handle 10 relative to the head 1.

Figure 5:
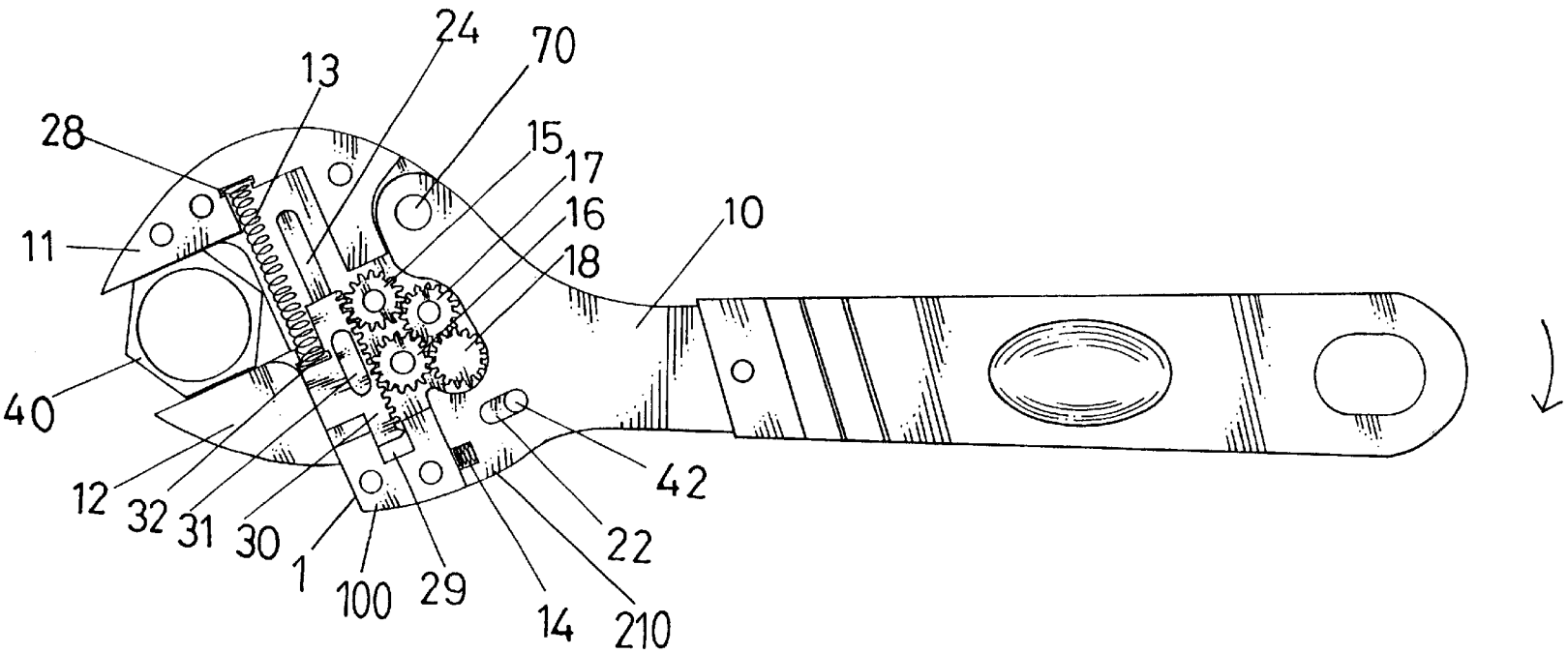
FIGS. 5 and 6 are top plane views for illustrating the operation of the tool, in which the cover plate is removed for showing the inner structure of the tool.
Figure 6:
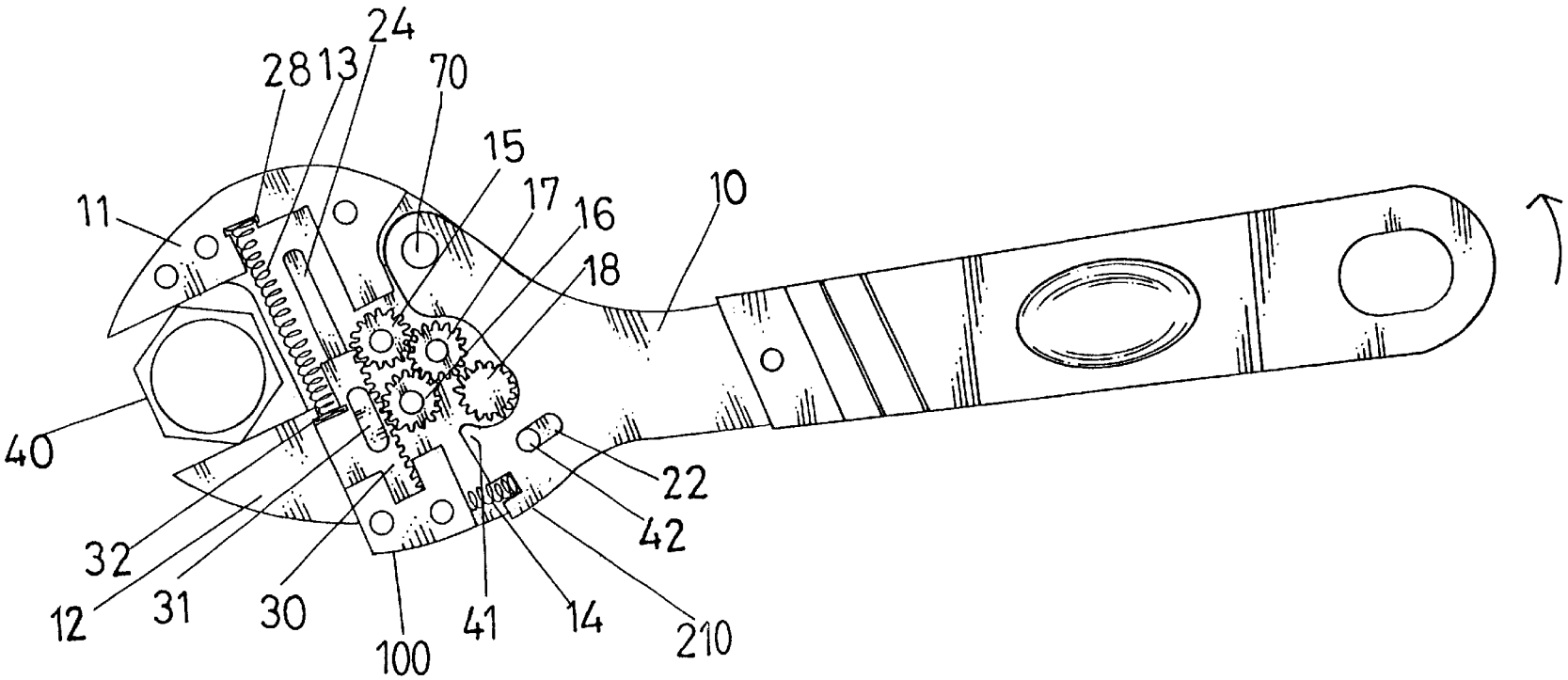

A movable jaw 12 includes a rack 30 formed thereon and includes one or more protrusions 31 extended therefrom and slidably received in the groove 24 of the head 1 for guiding the movable jaw 12 to move toward and away from the fixed jaw 11. The rack 30 includes a portion slidably received in the channel 29 of the block 100. A spring 13 has one end engaged in a cavity 28 of the head 1 and has the other end engaged in the other cavity 32 of the movable jaw 12 for biasing and moving the movable jaw 12 toward the fixed jaw 11 and to clamp 40 the fastener 40 between the jaws 11, 12 (FIGS. 5, 6). The head 1 includes a cover plate 19 secured thereto with the shaft 70 and the pin 42 and/or the other pins or fasteners, and includes a groove 33 formed in the cover plate 19 for slidably receiving and guiding one of the protrusions 31 of the movable jaw 12. Three gears 15, 16, 17 are rotatably secured between the head 1 and the cover plate 19 at pivot axles 71 respectively in which the gears 15, 16 are engaged with the rack 31 of the movable jaw 12 and the other gear 17 is engaged with the gears 15, 16. A further gear or pinion 18 is loosely received in the depression 20 of the handle 10 and is forced to engage with the gear(s) 16 or 17 by the handle 10. The pinion 18 may be disengaged from the gear(s) 16, 17 by the actuator 41 when the second side 210 of the handle 10 is rotated and moved away from the block 100 of the head 1. The spring 14 may bias the second side

210 of the handle 10 away from the block 100 of the head 1 for disengaging the pinion 18 from the gears 16, 17.

In operation, as shown in FIG. 6, when the second side 210 of the handle 10 is biased away from the block 100 of the head 1 by the spring 14, the movable jaw 12 may be moved away from the fixed jaw 11 against the spring 13 for engaging a fastener 40 to be driven by the tool between the jaws 11, 12. As shown in FIG. 5, when the handle 10 is rotated, clockwise, relative to the head 1 and the fastener 40 about the pivot shaft 70, the second side 210 of the handle 10 may be forced to engage with the block 100 of the head 1 and may force the pinion 18 to engage with the gear(s) 16, 17 such that the fastener 40 and the head 1 may be rotated clockwise by the handle 10 at this moment. When the handle 10 is released or is rotated, counterclockwise, relative to the head 1 and the fastener 40 about the pivot shaft 70, the second side 210 of the handle 10 may be biased away from the block 100 of the head 1 such that the pinion 18 may be released and may be disengaged from the gear(s) 16, 17. At this moment, the movable jaw 12 may be moved away from the fixed jaw 11 by the fastener 40 against the spring 13 when the head 1 is rotated counterclockwise relative to the fastener 40 such that the head 1 may be rotated counterclockwise and freely relative to the fastener 40 by the handle 10 and such that the fastener 40 may be rotated and driven by the tool step by step.

It is to be noted that, without the gears 15, 16, 17, and the pinion 18 and the rack 31, the handle 10 may engage with the movable jaw 12 directly and may force the movable jaw 12 to engage with and to clamp and to lock the fastener 40 between the jaws 11, 12 and thus to drive the fastener 40. The handle 10 may also include the actuator 41 to engage with the movable jaw 12 or the rack 31 of the movable jaw 12 directly, or via the gear 15, or via the gears 15, 16, or via the gears 15, 16, 17, or via the gears 15–17 and the pinion 18 and to secure and the lock the movable 12 to the fastener 40 and thus to rotate and drive the fastener 40.

Accordingly, the tool in accordance with the present invention includes a self adjusting mechanism for allowing the tool to drive the fasteners without being disengaged from the fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a head including a first end having a first jaw provided thereon and including a second end, a second jaw slidably engaged in said head and movable toward and away from said first jaw for clamping a fastener to be driven between said first and said second jaws, and a handle including a first portion pivotally secured to said first end of said head at a pivot shaft and including a second portion selectively engaged with said second end of said head, said second portion of said handle being allowed to be moved toward and away from said second end of said head when said handle is rotated relative to said head about said pivot shaft, and said handle being allowed to be engaged with said second jaw to force said second jaw toward said first jaw and to engage with the fastener when said handle is rotated relative to said head about said pivot shaft.

2. The tool according to claim 1 further comprising means for limiting a rotational movement of said handle relative to said head about said pivot shaft.

3. The tool according to claim 2, wherein said limiting means includes an oblong hole formed in said second portion of said handle, and a pin secured in said second end of said head and slidably received in said oblong hole of said handle to limit the rotational movement of said handle relative to said head.

4. The tool according to claim 1, wherein said head includes a groove formed therein, said second jaw includes a protrusion extended therefrom and slidably engaged in said groove of said head for guiding said second jaw to move toward and away from said first jaw.

5. The tool according to claim 1 further comprising means for biasing said second jaw toward said first jaw to lock the fastener between said first and said second jaws.

6. The tool according to claim 1, wherein said head includes a cover plate secured thereto for slidably retaining said second jaw in said head.

7. The tool according to claim 1, wherein said second portion of said handle includes an actuator for engaging with said second jaw and for forcing said second jaw toward said first jaw.

8. The tool according to claim 6, wherein said second jaw includes a rack provided thereon, said actuator of said handle is engaged with said rack of said second jaw for forcing said second jaw toward said first jaw.

9. The tool according to claim 8 further comprising at least one gear rotatably secured in said head and engaged with said rack, said actuator of said handle is engaged with said rack of said second jaw with said at least one gear for forcing said second jaw toward paid first jaw.

10. The tool according to claim 9 further comprising a pinion received in said handle and selectively engaged with said first and said second gears when said second portion is forced toward said second end of said head.

11. The tool according to claim 8 further comprising a pair of first gears rotatably secured in said head and engaged with said rack, a second gear rotatably secured in said head and engaged with said first gears, said actuator of said handle is engaged with said rack of said second jaw with said first and said second gears for forcing said second jaw toward said first jaw.

12. The tool according to claim 11, wherein said handle includes a depression formed therein for receiving said first and said second gears and said pinion.

13. The tool according to claim 1 further comprising means for biasing said second portion of said handle away from said second end of said head.

* * * * *